US006161922A

United States Patent [19]

Shima et al.

[11] Patent Number: 6,161,922

[45] Date of Patent: Dec. 19, 2000

[54] ELECTROSTATIC INK-JET RECORDING HEAD HAVING A HEAD CHIP PROVIDED WITH GROOVE AND FLANGE PORTIONS

[75] Inventors: Kazuo Shima; Junichi Suetsugu; Tadashi Mizoguchi; Hitoshi Minemoto; Tomoya Saeki; Hitoshi Takemoto; Yoshihiro Hagiwara; Toru Yakushiji, all of Niigata, Japan

[73] Assignee: NEC Corporation, Tokyo, Japan

[21] Appl. No.: 09/084,835

[22] Filed: May 26, 1998

[30] Foreign Application Priority Data

May 26, 1997 [JP] Japan ..... 9-135143

[51] Int. Cl.[7] ..... B41J 2/06

[52] U.S. Cl. ..... 347/55

[58] Field of Search ..... 347/20, 44, 47, 347/48, 54, 55, 63, 65, 66, 141, 124, 123, 125

[56] References Cited

U.S. PATENT DOCUMENTS

| | | | |
|---|---|---|---|
| 5,455,613 | 10/1995 | Canfield et al. | 347/65 |
| 5,774,150 | 6/1998 | Kobayashi et al. | 347/63 |
| 5,774,151 | 6/1998 | Sugitani et al. | 347/63 |
| 5,774,152 | 6/1998 | Namba et al. | 347/65 |
| 6,059,399 | 5/2000 | Suetsugu et al. | 347/55 |
| 6,074,044 | 6/2000 | Suetsugu et al. | 347/55 |
| 6,079,817 | 6/2000 | Shima et al. | 347/55 |

FOREIGN PATENT DOCUMENTS

| | | |
|---|---|---|
| 0703081 | 3/1996 | European Pat. Off. . |
| 0813969 | 12/1997 | European Pat. Off. . |
| 56-167473 | 12/1981 | Japan . |
| 58-124662 | 7/1983 | Japan . |
| 93/11866 | 6/1993 | WIPO . |
| 9311866 | 6/1993 | WIPO . |
| 9727058 | 7/1997 | WIPO . |
| 9727060 | 7/1997 | WIPO . |

*Primary Examiner*—Susan S. Y. Lee

*Attorney, Agent, or Firm*—Ostrolenk, Faber, Gerb & Soffen, LLP

[57] ABSTRACT

The electrostatic ink-jet recording head has a head member having a chamber for supplying and discharging ink, a head chip in which a plurality of continuous meniscus shapes are respectively formed on groove portions, a cover plate formed so as to expose a part of the corners of the groove and flange portions, and a protruded member on which pectinate protrusions are formed at the same intervals as those of the meniscus shapes formed on the head chip. A recording electrode is formed on each groove portion. Each protrusion of the protruded member is set on each groove portion of the head chip and moreover, formed so as to be protruded beyond the corner of the flange portion.

8 Claims, 8 Drawing Sheets

ELECTROSTATIC INK-JET RECORDING HEAD HAVING A HEAD CHIP PROVIDED WITH GROOVE AND FLANGE PORTIONS

BACKGROUND OF THE INVENTION

1. Field of the Invention

The present invention relates to an electrostatic ink-jet recording head, particularly to an electrostatic ink-jet recording head for performing recording by ejecting toner onto a recording medium.

2. Description of the Prior Art

Non-impact recording methods are superior to impact recording methods because noises generated during recording are very small. Among the non-impact recording methods, methods using ink-jet recording make it possible to record characters on plain paper with simple mechanisms. In view of these advantages, various ink-jet recording methods have been proposed so far.

A conventional ink-jet recording method is performed by using ink obtained by dispersing toner grains into a carrier liquid, applying a voltage between a pointed recording electrode and an electrode provided behind the recording paper so as to face toward the pointed recording electrode, and ejecting toner grains contained in the ink to the recording paper by the electrostatic force of a generated electric field as disclosed in PCT Publication No. WO 93/11866. FIG. 9 is a perspective view of a conventional ink-jet recording head obtained by modifying the ink-jet recording device disclosed in WO 93/11866, FIG. 10A is an enlarged view of a portion in the vicinity of the ink-jet port (portion a) as viewed from the top of that portion when ink is supplied from the recording head, and FIG. 10B is a cross-sectional view taken along the line b—b in FIG. 10A.

In FIGS. 9 and 10A, 10B, a substrate 101 is an insulator made of plastic or the like, which supports a base film 110 on its upper surface. The base film 110 is an insulator made of polyamide or the like having a thickness of approx. 50 $\mu$m and has a plurality of recording electrodes 102 formed integrally with its upper surface. The recording electrodes 102 are obtained by pattern-plating a conductive material such as copper on the base film 110 up to a thickness between 20 and 30 $\mu$m and arranged at a pitch of 300 dpi (dots per inch), that is, at an interval of approx. 85 $\mu$m. Moreover, each of the recording electrodes 102 independently protrudes beyond an end of the base film 110 between 80 and 500 $\mu$m. Furthermore, the surface of each recording electrode 102 is uniformly covered with an insulating coating member 103 having a thickness of 10 $\mu$m or less. The base film 110 is formed from a TAB (Tape Automated Bonding) tape and the insulating coating member 103 is formed through chemical vapor deposition of Parylene.

A cover 104 is set on the base film 110 so that it does not cover the protrusions of the recording electrodes 102. The cover 104 is an insulating member on which an ink supply port 105 and an ink discharge port 106 are previously formed. A space formed with the base film 110 and the cover 104 constitutes an ink chamber which is filled with ink supplied from the ink supply port 105. Moreover, the front end of the cover 104 opens and a slit-like aperture defined between the base film 110 and the cover 104 forms an ink jet port 107 on which an ink meniscus 108 are formed.

Ink forms the ink meniscus 108 on the ink jet port 107 according to its surface tension as shown in FIGS. 10A and 10B. Because a negative pressure is applied to the ink in the head and the recording electrodes 102 protrude beyond the base film 110 and cover 104, the ink meniscus 108 has a diagonally downward concave shape when viewed from its side. Moreover, because the recording electrodes 102 individually protrude to the outside of the ink jet port 107, an ink meniscus 108 is formed correspondingly at each recording electrode 102.

Therefore, when applying a high-voltage pulse to a selected recording electrode 102, an electric field is concentrated on the protruded front end of the recording electrode 102 having an ink meniscus formed thereon. The electrified toner in the ink is propelled by the electric field and discharged from the protruded front end toward an electrode (not illustrated) facing the ink-jet recording head, that is, in the direction of the recording paper, as toner agglomerations 109.

Other ink-jet recording devices using electrostatic force are disclosed in the official gazette of Japanese Patent Application Laid-Open No. 58-124662, issued on Jul. 25, 1983, and the official gazette of Japanese Patent Application Laid-Open No. 56-167473, issued on Dec. 23, 1981.

In the case of the ink-jet recording device disclosed in the official gazette of Japanese Patent Application Laid-Open No. 58-124662, the discharge point of an ink discharge port is formed on the front end of a separation wall for defining an ink channel. The separation wall is formed along a recording electrode, and the discharging point is formed at the end of the recording electrode.

In the case of the ink-jet recording device disclosed in the official gazette of Japanese Patent Application Laid-Open No. 56-167473, a division plate for dividing an ink channel is formed in the ink channel. The division plate has a plurality of recording electrodes on both surfaces thereof. The front end of the division plate is formed so as to protrude beyond an ink discharge port.

A first problem of these conventional electrostatic ink-jet recording heads lies in the fact that the quantity of toner grains for forming a desired dot are not sufficiently supplied to the discharge point. This is because the discharge point is formed by a recording electrode, wherein the electrostatic force directed toward the discharge point does not affect a sufficient amount of toner grains near the discharge point when a recording voltage is applied. Therefore, not enough toner grains to form a desired dot is concentrated on the discharge point.

A second problem in the prior art lies in the fact that ink droplets are unstably discharged. This is because the plurality of convex ink meniscuses using the discharge points as apexes are continuously connected to each other, whereby vibrations of the liquid surface near a discharge point generated while discharging ink influence the ink meniscuses of other discharge points. Therefore, the ink meniscuses cannot always be stably obtained.

A third problem lies in the fact that ink droplets are irregularly discharged due to concentration of excessive toner grains. This problem occurs in the prior art shown in FIGS. 9 and 10A, 10B and the official gazette of Japanese Patent Application Laid-Open No. 56-167473. This is because the discharge aperture for supplying ink to the discharge point is formed as a slit on a part of the ink chamber so as to prevent ink from overflowing. Therefore, the ink does not flow in the discharge aperture, causing the ink viscosity to increase due to concentration of excessive toner grains in the discharge aperture.

The present invention is made to solve the above problems by providing an electrostatic ink-jet recording head for discharging ink droplets containing toner grains in an electrostatic field, wherein the recording head is capable of preventing the problem of an insufficient amount of toner grains for forming a desired dot, stably discharging ink droplets, and moreover preventing ink droplets form being irregularly discharged due to a concentration of excessive toner grains in a discharge aperture.

SUMMARY OF THE INVENTION

An electrostatic ink-jet recording head of the present invention is used for recording characters by applying an electric field to ink in which electrified toner grains are dispersed, and by discharging said toner grains by an electrostatic force generated by said electric field.

The ink-jet recording head has a head member having a chamber for supplying ink; a head chip fixed to the head member and having flange portions and groove portions arranged alternately in a direction perpendicular to an ink ejecting direction, a plurality of continuous meniscus shapes being respectively formed on the groove portions; a recording electrode formed on each of the groove portions; and protrusions which are provided with the head chip at the same intervals as those of the meniscus shapes formed on the groove portions. Each of the protrusions is located on a corresponding one of the groove portions and protrudes beyond the ends of the flange portions in the ink ejecting direction.

According to the above present invention, discharge points are formed on the protrusions protruding beyond the ends of the flange portions. While a recording voltage is applied to the recording electrode, an equipotential line is formed near the discharge point so as to be almost perpendicular to the discharge or ejecting direction, and an electrostatic force in the direction toward the discharge point is exerted on the electrified toner grains near the discharge point.

Therefore, even while the recording voltage is selectively applied to the recording electrode on each of the groove portions, toner grains are stably supplied onto the discharge point. Moreover, because an ink bank is present on the recording electrode, due to a convex meniscus, it is possible to obtain a sufficient amount of toner grains for forming a desired dot.

BRIEF DESCRIPTION OF THE DRAWINGS

The above-mentioned object and other objects, features and advantages of this invention will become more apparent by reference to the following detailed description of the invention taken in conjunction with the accompanying drawings, wherein.

DETAILED DESCRIPTION OF THE PREFERRED EMBODIMENTS

Figure 1:
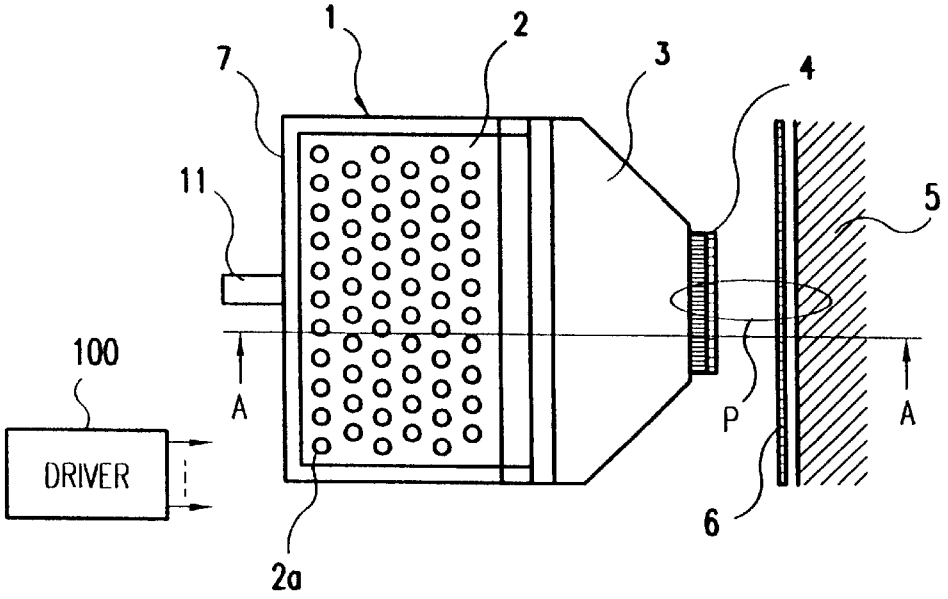
FIG. 1 is a schematic diagram of an embodiment of an electrostatic ink-jet recording head of the present invention.
Figure 2:
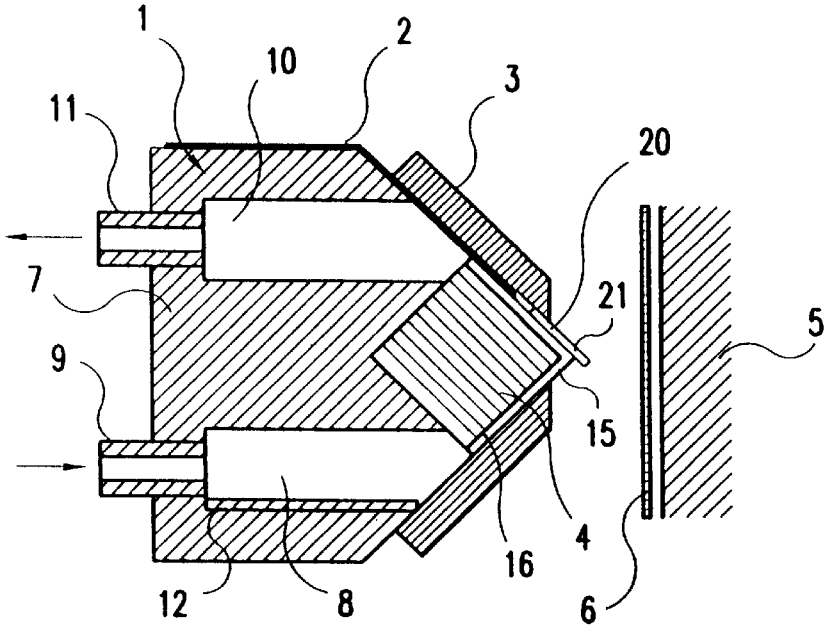
FIG. 2 is a cross-sectional view taken along the line A—A of FIG. 1.

FIG. 1 is a schematic diagram of an embodiment of an electrostatic ink-jet recording head of the present invention, and FIG. 2 is a cross-sectional view taken along the line A—A in FIG. 1.

In FIGS. 1 and 2, an ink-jet recording head 1 has a head member 7, a cover plate 3, a head chip 4, a contact substrate 2 having electrical contact lines (not shown). At the front of the recording head 1, a sheet of recording paper 6 is positioned with a predetermined gap between the paper 6 and the recording head 1, and an opposite electrode 5 is located on the opposite side of the recording paper 6 relative to the recording head 1.

An inner chamber 8 (FIG. 2) and an outer chamber 10 are independently formed in the head member 7. An ink supply port 9 communicating with an ink tank (not illustrated) is formed on the part of the inner chamber 8 and an ink discharge port 11 communicating with an ink tank (not illustrated) is formed on a part of the outer chamber 10.

The head chip 4 is coupled to a front end of the head member 7. The head chip 4 has a shape of a quadrilateral solid made of an insulating material having a low permittivity such as a ceramic or macromolecular material as a base material.

The contact substrate 2 is fixed on the head member 7 and a front end of the contact substrate 2 reaches the head chip 4. The contact substrate 2 has a plurality of contact electrodes 2*a* as shown in FIG. 1 to connect them to a driver 100.

The cover plate 3 is fixed on a forward portion of the head member 7 and on the head chip 4 on the side thereof facing the opposite electrode 5. An opening is formed in the cover plate 3 so as to permit a corner end of the head chip 4 to protrude from the opening in the ink ejecting direction.

Figure 3:
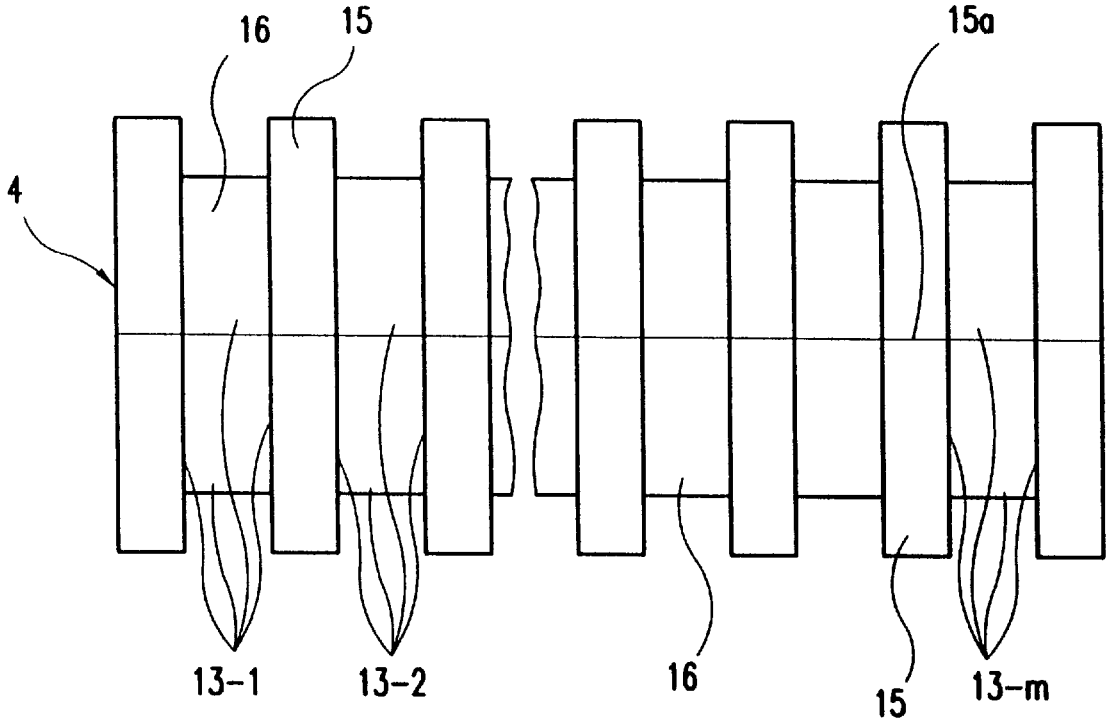
FIG. 3 is an enlarged front view of a head chip of the electrostatic ink-jet recording head of FIGS. 1 and 2.

As shown in FIG. 3, the head chip 4 is provided with flange portions 15 and groove portions 16 at the side facing the opposite electrode 5. A tip 15*a* of each of the flange portions 15 protrudes toward the opposite electrode 5 of FIG. 2 (in the ink ejecting direction). The flange portions 15 are arranged at the same interval as a desired dot pitch.

Figure 5:
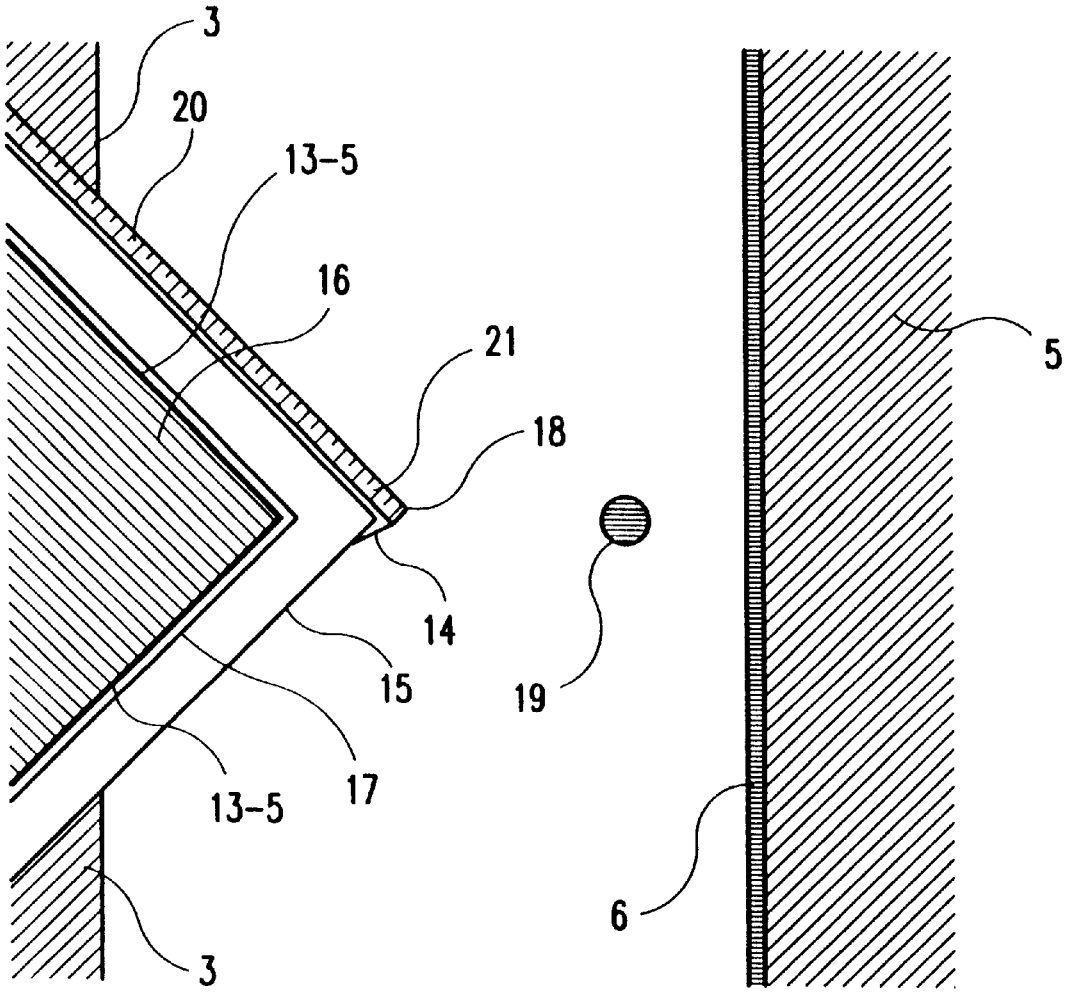
FIG. 5 is a cross-sectional view taken along the line B—B of FIG. 4.

In FIG. 3, each of recording electrodes 13-*l* to 13-*m* ("m" is an integer) is formed on two surfaces of each groove portion 16 and the side surfaces of two corresponding flange portions 15 facing each other. It is noted that the recording electrodes are not formed on the front surfaces of the flange portions 15 facing the opposite electrode 5. As shown in FIG. 5, each of the recording electrodes 13-*l* to 13-*m* is covered with an insulating film 17.

The recording electrodes 13-*l* to 13-*m* are connected with the electrical contact lines (not shown) formed in the contact substrate 2 of FIGS. 1 and 2. The contact substrate 2 is a TAB tape. As shown in FIG. 1, the contact substrate 2 has the contact electrodes 2*a* which are connected to the recording electrodes 13-*l* to 13-*m* (FIG. 3) through the electrical contact lines (not shown). The contact electrodes 2*a* are connected to the external driver 100 to be supplied with ejection signals for ejecting ink.

Figure 4:
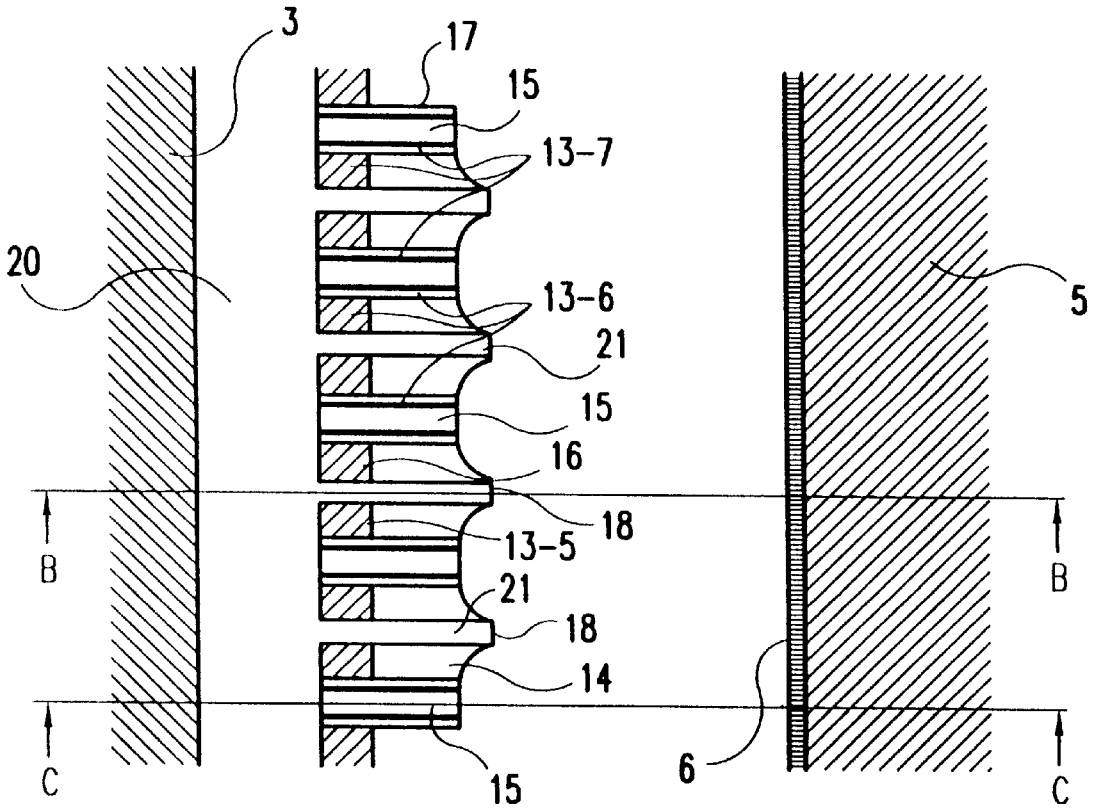
FIG. 4 is an enlarged view of a portion P of the electrostatic ink-jet recording head of the embodiment in FIG. 1.
Figure 6:
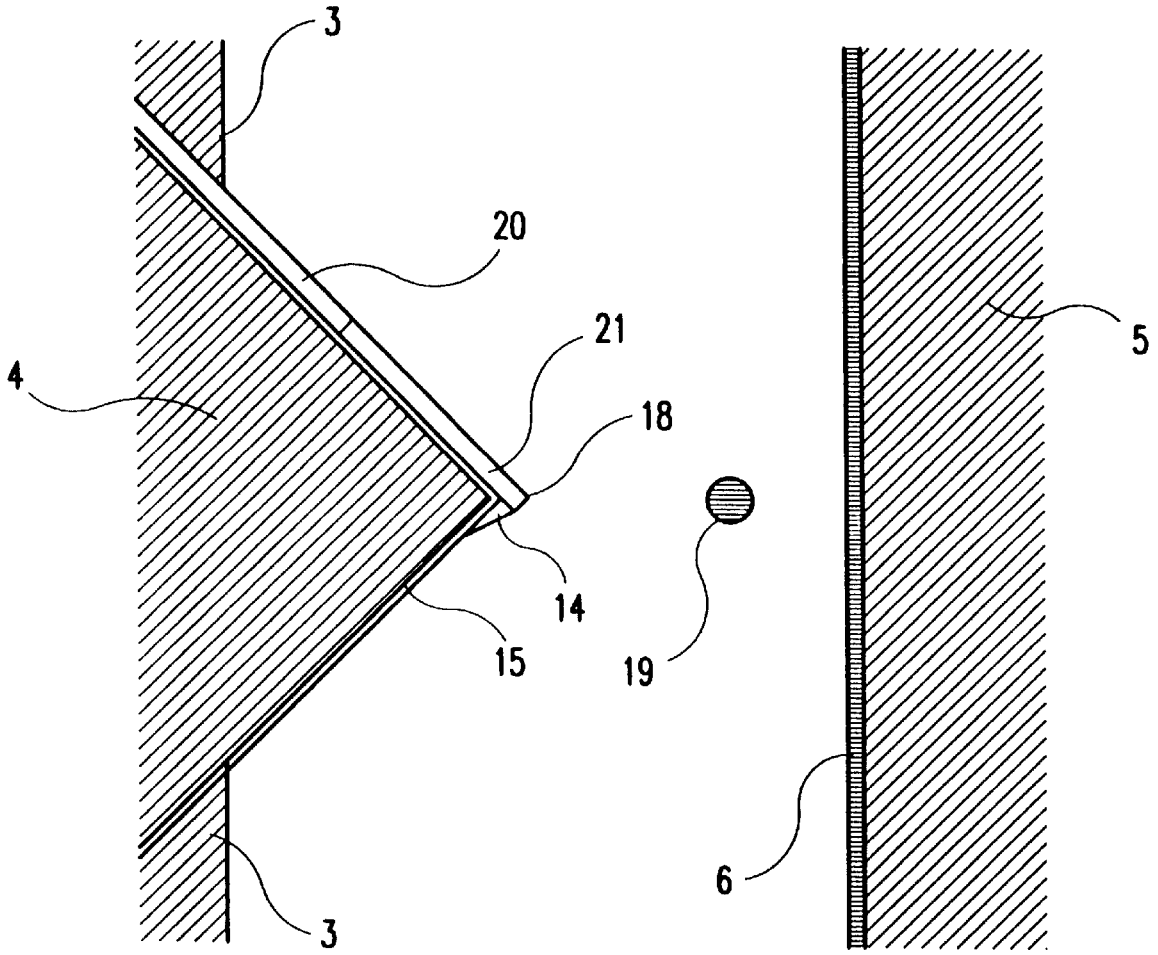
FIG. 6 is a cross-sectional view taken along the line C—C of FIG. 4.

As shown in FIGS. 4 to 6, the flange portions 15 and the groove portions 16 are arranged alternately in a direction perpendicular to the ink ejecting direction. A protruded member 20 is fixed on rear portions of the flange portions 15. The protruded member 20 covers the rear portions of the flange portions 15 but does not cover the forward portions (end portions) of the flange portions 15. The protruded member 20 is made of an insulating material having a low permittivity such as a ceramic or macromolecular material. Protrusions 21 are pectinately formed at one end of the protruded member 20 at the same interval as a desired dot pitch. The protrusions 21 and the flange portions 15 are alternately positioned as shown in FIG. 4. Each protrusion 21 is located along the top of each groove portion 16 and does not contact the recording electrodes 13-*l* to 13-*m*. The protrusions 21 protrude beyond the flange portions 15 to form discharging points 18.

The front end of each protrusion 21 is set on one meniscus-forming plane on the head chip 4 so as to protrude beyond the corner of the flange portion 15 formed between two planes on the head chip 4.

In FIG. 2, the inner chamber 8 and the outer chamber 10 respectively are connected through the groove portions 16 of the head chip 4, and the ink 14 in the inner chamber 8 and that in the outer chamber 10 are in communication with each other through the groove portions 16.

Thereby, the ink 14 supplied to the inner chamber 8 from an ink tank (not illustrated) through the ink supply port 9 is channeled into the outer chamber 10 through the groove portions 16 formed on the head chip 4 and collected in an ink tank (not illustrated) through the ink discharge port 11. To prevent bubbles remaining in the recording head 1 from coming through the head chip 4, it is preferred that the outer chamber 10 is formed so as to be above the inner chamber 8.

The forward portions of the flange portions 15, the groove portions 16 and the protrusions 21 protrude from the opening of the cover plate 3, on which surfaces the meniscuses are formed on the head chip 4. The meniscus shapes on the head chip 4 have peaks at positions corresponding to the discharge points 18 (FIGS. 4 to 6), at which ink droplets 19 are ejected. This configuration prevents excessive ink 14 supplied from the groove portions 16 of the head chip 4 from overflowing.

A migration electrode 12 is made of a conductive material such as a metal and is connected with an external power supply (not illustrated) and is set in the inner chamber 8 so as to contact the ink 14 supplied into the inner chamber 8.

The opposite electrode 5 is made of a conductive material such as a metal and is grounded or connected with an external power supply (not illustrated) and is positioned so that the discharge point 18 in the recording head 1 closely approaches the opposite electrode 5 while maintaining a recording gap between the opposite electrode 5 and the recording head 1. Moreover, the recording paper 6 is transferred through the recording gap between the opposite electrode 5 and the recording head 1 so as to contact the opposite electrode 5 and become electrified up to a potential equal to that of the opposite electrode 5.

A positive constant bias voltage is continuously applied to the migration electrode 12 and a ground-level voltage or negative constant bias voltage is continuously applied to the opposite electrode 5.

The ink 14 in the recording head 1 is constantly circulated by an external pump (not illustrated) between an ink tank (not illustrated) and the recording head 1 through the ink supply port 9 and ink discharge port 11. Moreover, the ink 14 is supplied by using each groove portion 16 in the head chip 4 as a channel such that an independent convex meniscus is formed at every groove portion 16 by using the front end of each protrusion 21 of the protruded member 20 as the discharge point 18.

The ink 14 supplied to the inner chamber 8 is charged to a potential at which the ink 14 is not discharged by the migration electrode 12 contacting the ink 14. From the inner chamber 8, the ink 14 is supplied to the discharge point 18 by using each groove portion 16 on the head chip 4 as a channel.

When printing, a driving pulse voltage from the driver 100 is selectively applied to the recording electrodes 13-*l* to 13-*m*, and then an electrostatic force is exerted on the toner in the ink 14 supplied to the discharge point 18 by an electric field generated between the recording electrodes 13-*l* to 13-*m* and the opposite electrode 5. When the electrostatic force of the toner overcomes the surface tension of the meniscus on the discharge point 18, the ink droplet 19 containing electrified toner agglomerations on the discharge point 18 is discharged toward the opposite electrode 5 and characters are printed on the recording paper 6.

Thereafter, because the ink continuously flows in the direction from the inner chamber 8 toward the outer chamber 10 while passing through the discharge point 18, any toner not discharged is directly transferred toward the outer chamber 10 independently from the discharge of the ink droplet 19.

Figure 8:
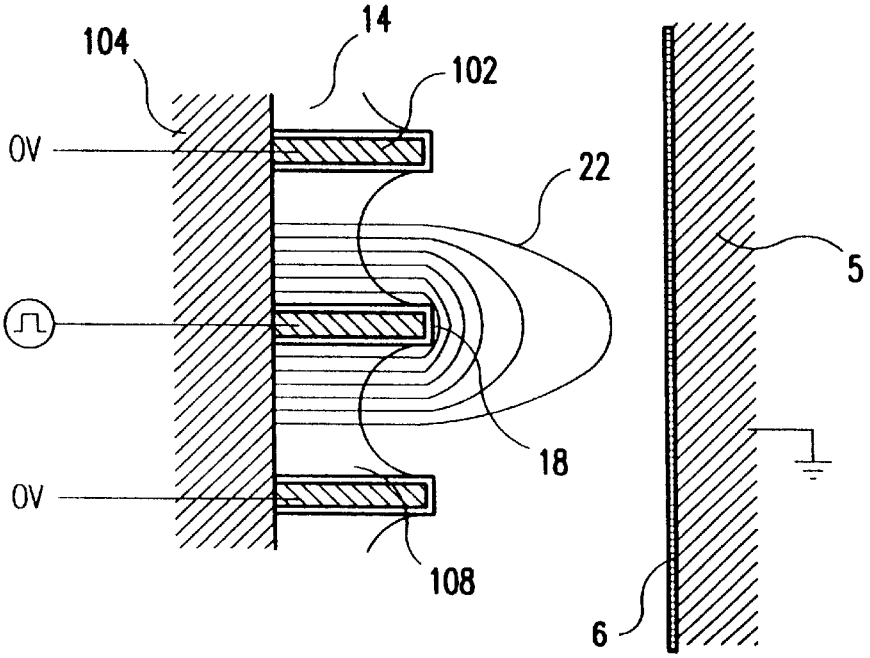
FIG.8 PRIOR ART
FIG. 8 is a schematic view of equipotential lines generated when a conventional electrostatic ink-jet recording head records characters.
Figure 9:
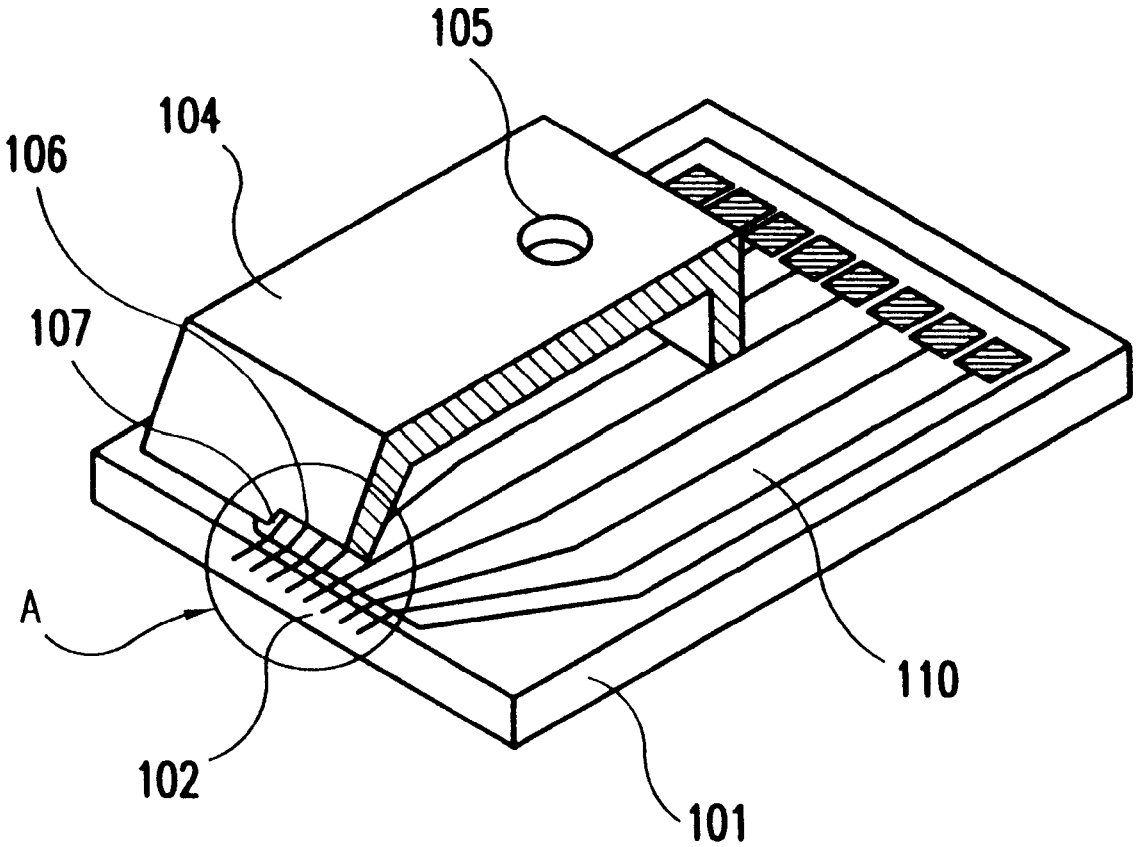
FIG.9 PRIOR ART
FIG. 9 is perspective view of a conventional electrostatic ink-jet print head.
Figure 10A:
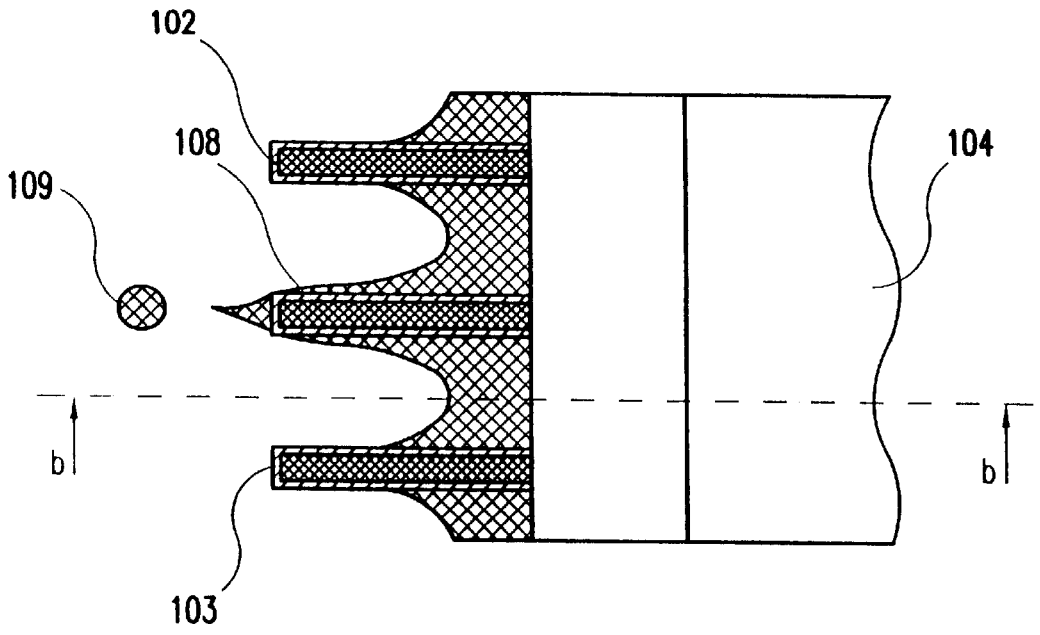
FIG.10A PRIOR ART
FIG. 10A is a top view of the front end of the conventional electrostatic ink-jet recording head in FIG. 9.
Figure 10B:
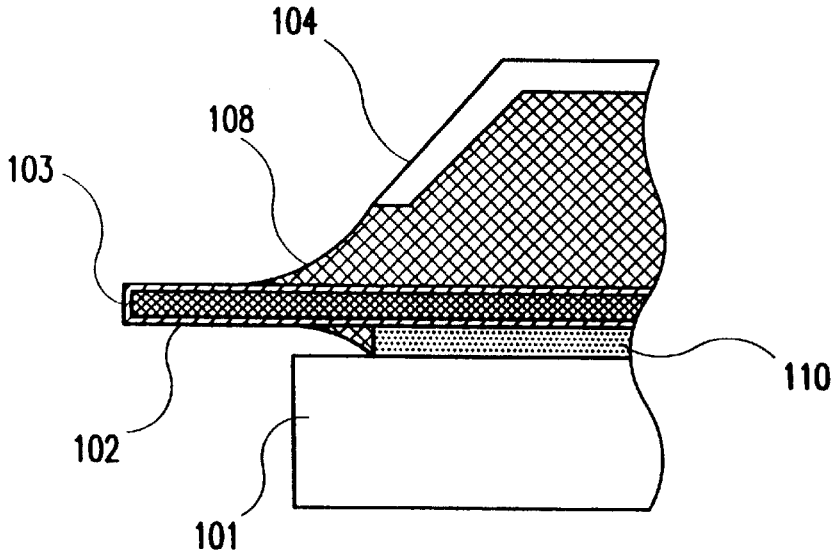
FIG.10B PRIOR ART
FIG. 10B is a cross-sectional view taken along the line b—b in FIG. 10A.

FIG. 8 is a schematic view of equipotential lines generated when a conventional electrostatic ink-jet recording head prints characters. In FIG. 8, an equipotential line 22 near the discharge point 18, generated when the recording voltage is applied, is formed along the shape of each of the recording electrodes 102. The equipotential line 22 is almost parallel with the discharge direction and is exerted on the ink 14 near each of the discharge points 18. Therefore, if the toner grains in the ink 14 are insufficiently supplied onto the discharge point 18 while a recording voltage is applied to the recording electrodes, it is impossible to obtain sufficient toner agglomerations for forming a desired dot.

Figure 7:
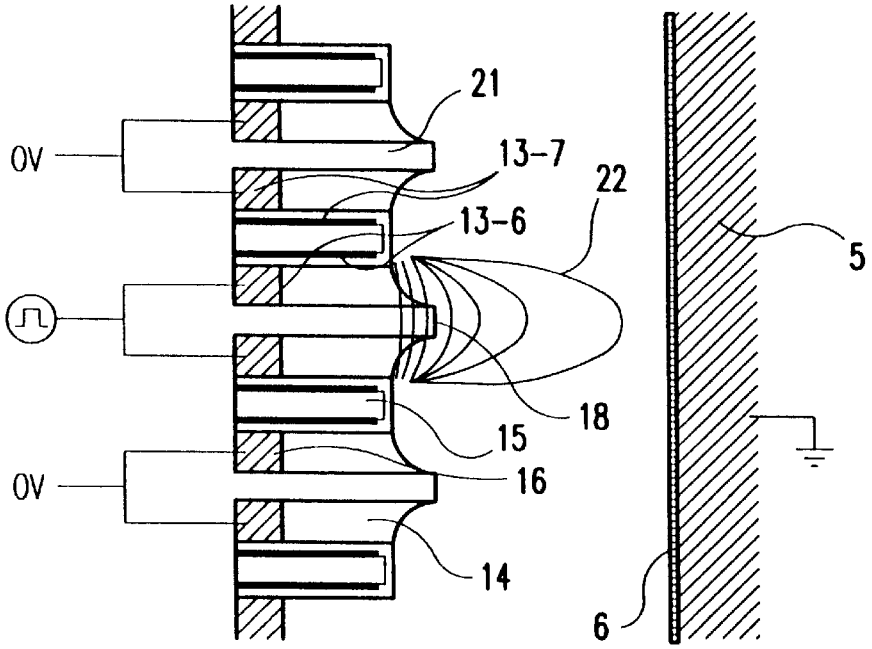
FIG. 7 is a schematic view of equipotential lines generated when the electrostatic ink-jet recording head of the embodiment in FIG. 4 records characters.

FIG. 7 is a schematic view of equipotential lines generated when the electrostatic ink-jet recording head of this embodiment prints characters. In FIG. 7, the equipotential line 22 near the discharge point 18 produced while a recording voltage is applied to the recording electrodes 13-*l* to 13-*m* is formed so as to be almost perpendicular to the discharge direction, whereby an electrostatic force in the direction toward the discharge point 18 is generated on the electrified toner grains near the discharge point 18. Therefore, even while the recording voltage is selectively applied to the recording electrode 13-*l* to 13-*m*, toner grains are stably supplied onto the discharge point 18. Moreover, because an ink bank due to a convex meniscus is present on the recording electrode 13, it is possible to agglomerate enough toner grains for forming a desired dot.

As described above, the first advantage of the present invention lies in the fact that enough toner grains (agglomerations) can be accumulated to form a desired dot. This is because discharge points are formed further forward than the recording electrodes. Moreover, each recording electrode is formed so as to surround each discharge point and thereby, it is possible to generate an electrostatic force in the direction toward the discharge points for the toner grains near the discharge points when a recording voltage is applied and thus, it is possible to collect enough toner grains to form a desired dot on the discharge points.

The second advantage lies in the fact that ink droplets can be stably discharged. This is because each convex ink meniscus using a discharge point as an apex is independent in each groove portion on a head chip and vibrations of the liquid surface near a discharge point discharging ink droplets do not influence the ink meniscuses of other discharge points and thus, it is possible to always obtain a stable ink meniscus.

The third advantage lies in the fact that it is possible to prevent ink droplets from being irregularly discharged due to concentration of excessive toner grains. This is because a forced flow in the direction from an inner chamber toward an outer chamber is made to occur in each groove portion formed near a discharge point and thereby, it is possible to prevent toner grains from accumulating near the discharge points closest to the opposite electrode.

What is claimed is:

1. An electrostatic ink-jet recording head for recording characters by applying an electric field to ink in which electrified toner grains are dispersed and discharging said toner grains by an electrostatic force generated by said electric field, comprising:

a head member having a chamber for supplying ink;

a head chip fixed to said head member and having flange portions and groove portions arranged alternately in a direction perpendicular to an ink ejecting direction;

a recording electrode formed on each of said groove portions; and protrusions which are provided on said head chip at the same intervals as those of said groove portions, each of said protrusions being located on each of said groove portions and protruding beyond ends of the flange portions in a direction of the ink ejecting direction.

2. The electrostatic ink-jet recording head according to claim 1, further comprising a cover member which covers said head chip and is provided with an opening so as to expose ends of said groove and flange portions.

3. The electrostatic ink-jet recording head according to claim 1, wherein said recording electrodes are further formed on side surfaces of each flange portions of said head chip.

4. The electrostatic ink-jet recording head according to claim 3, wherein said flange portions and said groove portions are formed on two planes of the head chip which intersect to form a corner that protrudes in the direction of the ink ejecting direction.

5. The electrostatic ink-jet recording head according to claim 4, wherein said head chip has a shape of a quadrilateral solid, and said flange and groove portions are formed on two planes of the quadrilateral solid so as to form corner ends of said flange portions and said groove portions along one corner of said quadrilateral solid.

6. The electrostatic inkjet recording head according to claim 1, wherein said chamber has an inner chamber for supplying the ink and an outer chamber for outputting the ink, and said inner chamber communicates with said outer chamber by using each of said groove portions as a channel.

7. The electrostatic ink-jet recording head according to claim 6, wherein a migration electrode in contact with ink is set in said inner chamber.

8. The electrostatic ink-jet recording head according to claim 3, wherein said recording electrodes are covered with an insulating film.

* * * * *